US006782827B2

(12) United States Patent
Miskelly, Jr.

(10) Patent No.: US 6,782,827 B2
(45) Date of Patent: Aug. 31, 2004

(54) SOLID PROPELLANT FORMULATIONS AND METHODS AND DEVICES EMPLOYING THE SAME FOR THE DESTRUCTION OF AIRBORNE BIOLOGICAL AND/OR CHEMICAL AGENTS

(75) Inventor: Hermann L. Miskelly, Jr., Warrenton, VA (US)

(73) Assignee: Aerojet-General Corporation, Redmond, WA (US)

( * ) Notice: Subject to any disclaimer, the term of this patent is extended or adjusted under 35 U.S.C. 154(b) by 0 days.

(21) Appl. No.: 10/377,775

(22) Filed: Mar. 4, 2003

(65) Prior Publication Data

US 2004/0025990 A1 Feb. 12, 2004

Related U.S. Application Data

(62) Division of application No. 10/145,540, filed on May 15, 2002.

(51) Int. Cl.[7] ..... F42B 10/00; C06B 45/10; C06B 45/00; C06B 33/06; C06B 29/22

(52) U.S. Cl. ..... 102/364; 102/287; 149/19.9; 149/42; 149/76

(58) Field of Search ..... 102/287, 364, 102/334, 335, 363, 367; 149/19.9, 42, 76

(56) References Cited

U.S. PATENT DOCUMENTS

| | | | | | |
|---|---|---|---|---|---|
| 3,105,350 | A | | 10/1963 | Eichenberger | 60/35.3 |
| 3,109,375 | A | | 11/1963 | Rumbel et al. | 102/98 |
| 3,129,561 | A | * | 4/1964 | Priapi | 102/287 |
| 3,133,841 | A | | 5/1964 | Kuehl | 149/5 |
| 3,166,896 | A | * | 1/1965 | Breitengross et al. | 102/287 |
| 3,191,535 | A | | 6/1965 | Mulloy | 102/98 |
| 3,260,208 | A | | 7/1966 | Schluter | 102/98 |
| 3,389,025 | A | | 6/1968 | Nix et al. | 149/19 |
| 3,467,012 | A | * | 9/1969 | Lapof | 102/364 |
| 3,706,608 | A | | 12/1972 | Geisier | 149/6 |
| 3,830,673 | A | | 8/1974 | Fletcher et al. | 149/17 |
| 3,865,035 | A | * | 2/1975 | Munson et al. | 102/364 |
| 3,933,543 | A | | 1/1976 | Madden | 149/21 |
| 3,951,068 | A | * | 4/1976 | Schroeder | 102/364 |
| 4,015,355 | A | * | 4/1977 | Schiessl et al. | 102/364 |
| 4,092,189 | A | | 5/1978 | Betts | 149/19.2 |
| 4,148,187 | A | | 4/1979 | Younkin | 60/245 |
| 4,365,557 | A | * | 12/1982 | Couture et al. | 102/364 |
| 4,381,692 | A | * | 5/1983 | Weintraub | 102/364 |
| 4,422,383 | A | * | 12/1983 | Couture et al. | 102/364 |
| 4,462,848 | A | | 7/1984 | Elrick | 149/19.92 |
| 4,744,301 | A | * | 5/1988 | Cardoen | 102/393 |
| 4,756,251 | A | | 7/1988 | Hightower et al. | 102/289 |
| 4,891,938 | A | | 1/1990 | Nagy et al. | 60/245 |
| 4,949,641 | A | * | 8/1990 | Sayles | 149/19.4 |
| 4,952,254 | A | | 8/1990 | Betts et al. | 149/19.4 |
| 5,682,009 | A | | 10/1997 | O'Meara et al. | 102/290 |
| 6,105,505 | A | * | 8/2000 | Jones | 102/364 |
| 6,382,105 | B1 | * | 5/2002 | Jones | 102/370 |

* cited by examiner

*Primary Examiner*—Aileen B. Felton
(74) *Attorney, Agent, or Firm*—Nixon & Vanderhye P.C.

(57) ABSTRACT

High temperature incendiary (HTI) devices and methods destroy biological and/or chemical agents. Preferably, such HTI devices include dual modal propellant compositions having low burn rate propellant particles dispersed in a matrix of a high burn rate propellant. Most preferably, the HTI device includes a casing which contains the dual modal propellant and a nozzle through which combustion gases generated by the ignited high burn rate propellant may be discharged thereby entraining ignited particles of the low burn rate propellant. In use, therefore, the high burn rate propellant will be ignited using a conventional igniter thereby generating combustion gases which are expelled through the nozzle of the HTI device. As the ignition face of the propellant composition regresses, the low burn rate particles will similarly become ignited. Since the low burn rate particles burn at a lesser rate as compared to the high burn rate propellant in which such particles are dispersed, the ignited particles per se will be expelled through the nozzle and will therefore continue to burn in the ambient environment. Such continued burning of the particles will thereby be sufficient to destroy chemical and/or biological agents that may be present in the ambient environment.

9 Claims, 1 Drawing Sheet

Figure 1A:
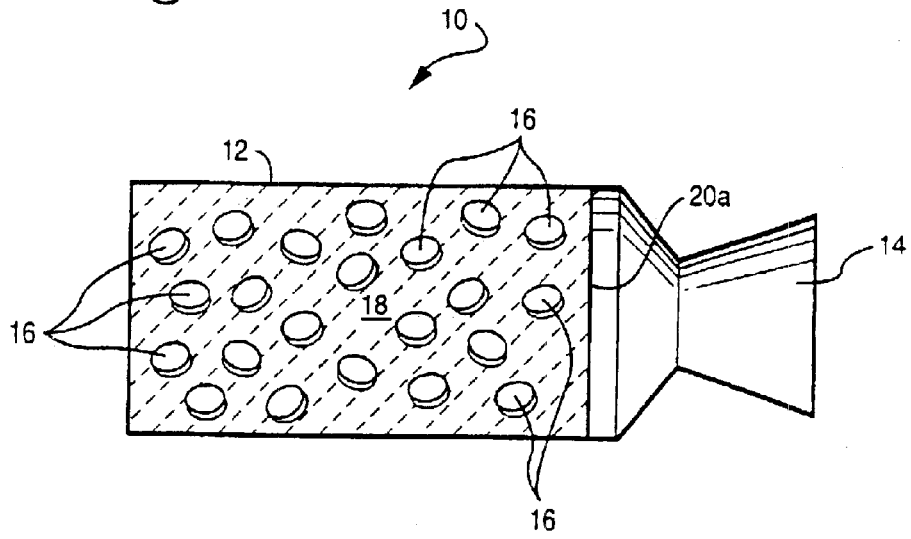

SOLID PROPELLANT FORMULATIONS AND METHODS AND DEVICES EMPLOYING THE SAME FOR THE DESTRUCTION OF AIRBORNE BIOLOGICAL AND/OR CHEMICAL AGENTS

This application is a Divisional of application Ser. No. 10/145,540, filed May 15, 2002, now pending, the entire content of which is hereby incorporated by reference in this application.

FIELD OF THE INVENTION

The present invention relates generally to solid propellant formulations and to methods and devices employing the same for the destruction of airborne biological and/or chemical agents.

BACKGROUND AND SUMMARY OF THE INVENTION

Propellants are chemical compounds or mixtures thereof which, upon ignition, exhibit self-sustained combustion and generate large volumes of hot gases at controlled, predetermined rates. Propellants serve as a convenient, compact form of storing relatively large amounts of energy and working fluid for rapid release and enjoy wide utility in various industrial and military applications. Thus, propellants are generally employed in various situations requiring a readily controllable source of energy such as ballistic applications (e.g., for periods of time ranging from milliseconds in weapons to minutes for space vehicles) wherein the generated gases function as a working fluid for propelling projectiles such as rockets and missile systems, and for pressurizing pistons and inflating containers.

When used as a propellant for rocket and missile systems, a propellant formulation is typically shaped as a cylinder, called a "grain." The propellant grain is combusted, typically at constant pressure within the interior of the rocket motor case. The rocket motor derives its thrust from the flow of the hot combustion products through the throat and out the nozzle of the motor case. Solid propellants are employed extensively in the aerospace industry for rockets and in the automotive industry for air bags. Solid propellants have evolved as the preferred method of powering most missiles and rockets for military applications and inflating air bags for civilian applications because they are relatively simple and economic to manufacture and use, and have excellent performance characteristics and are very reliable and safe.

It is known that propellants can be engineered so as to achieve desired burn rate characteristics. For example, U.S. Pat. No. 4,092,189 to Betts[1] discloses that granules of ultra-high burn rate propellants may be dispersed in a binder or lower burning rate propellant to achieve desired characteristics. U.S. Pat. No. 5,682,009 discloses that a burn deterrent may be gradationally dispersed within the particulate with the greatest concentration of burn deterrent at the particulate periphery. According to U.S. Pat. No. 4,462,848, relatively higher burning rate casting powder granules are distributed uniformly throughout a cross-linked double base propellant composition.

[1] This publication, as well as all other publications cited below, are expressly incorporated hereinto by reference.

The potential proliferation of hazardous biological and/or chemical agents has revealed the need for defenses in the event of their possible use to be improved, especially in military theater of operations. Typically, defenses against air borne biological and chemical agents has been limited to protective clothing and breathing apparatus. A need therefore exists to provide improved defenses against the potential use of such hazardous biological and/or chemical agents.

Broadly, the present invention is embodied in a high temperature incendiary (HTI) device and methods which destroy biological and/or chemical agents. More specifically, the present invention is embodied in dual modal propellant compositions for use in HTI devices, and to such HTI devices employing the same, wherein the propellant composition is comprised of low burn rate propellant particles dispersed in a matrix of a high burn rate propellant. Most preferably, the HTI device includes a casing which contains the dual modal propellant and a nozzle through which combustion gases generated by the ignited high burn rate propellant may be discharged thereby entraining ignited particles of the low burn rate propellant.

In use, therefore, the high burn rate propellant will be ignited using a conventional igniter (not shown) thereby generating combustion gases which are expelled through the nozzle of the HTI device. As the ignition face of the propellant composition regresses, the low burn rate particles will similarly become ignited. Since the low burn rate particles burn at a lesser rate as compared to the high burn rate propellant in which such particles are dispersed, the ignited particles per se will be expelled through the nozzle and will therefore continue to burn in the ambient environment. Such continued burning of the particles will thereby be sufficient to destroy chemical and/or biological agents that may be present in the ambient environment.

These and other aspects and advantages of the present invention will become more apparent after careful consideration is given to the following detailed description of the preferred exemplary embodiments thereof.

BRIEF DESCRIPTION OF THE ACCOMPANYING DRAWING

Figure 1B:
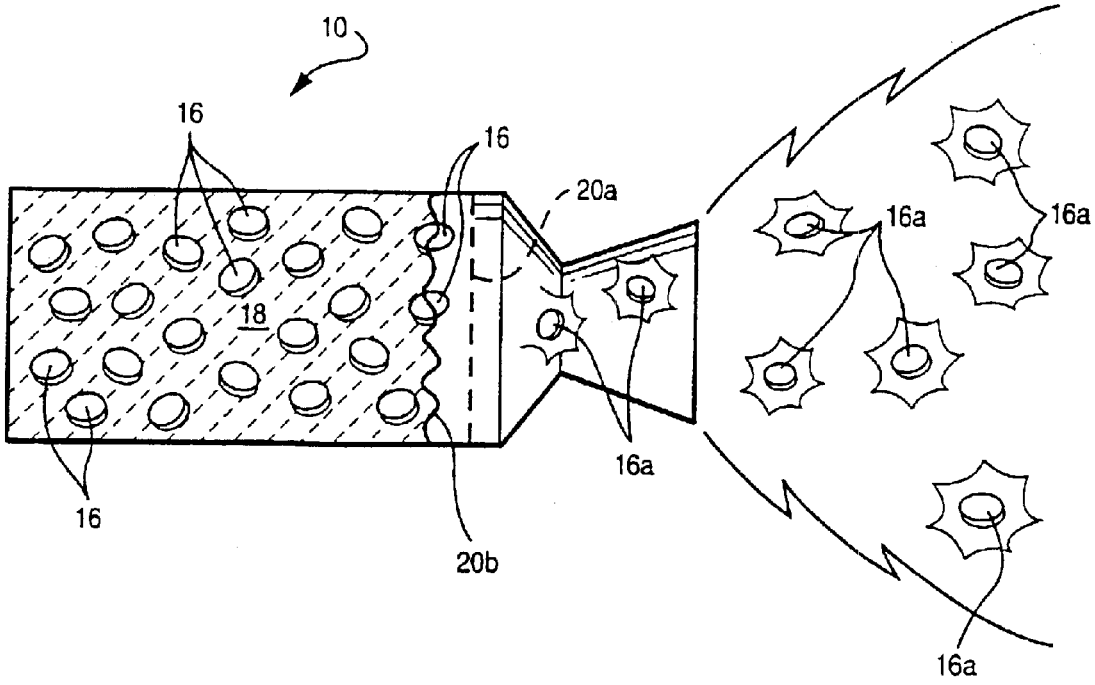

Reference will hereinafter be made to the accompanying drawing, wherein like reference numerals throughout the various FIGURES denote like elements, and wherein;

FIG. 1A is a schematic cross-sectional view of a high temperature incendiary (HTI) device in accordance with the present invention incorporating a dual-mode propellant thereof at a state prior to propellant ignition; and FIG. 1B is a schematic cross-sectional view of the HTI device depicted in FIG. 1A, but at a state following ignition of the propellant thereof.

DETAILED DESCRIPTION OF THE INVENTION

I. Definitions

As used herein, and in the accompanying claims, the terms noted below are intended to have the definitions as follows:

"High burn rate" means a propellant composition which, when ignited has a burn rate of at least about 1.00 inches per second (ips), and more preferably at least about 2.00 ips, or greater at a pressure condition of 1000 psi.

"Low burn rate" means a propellant composition which, when ignited has a burn rate of less than about 0.25 ips, and more preferably less than about 0.10 ips, at a pressure condition of 1000 psi.

"Average particle diameter" means the numerical average of the diameters of the smallest spheres which contain entirely a respective one of a low burn rate propellant particle.

II. Description of Preferred Embodiments

The HTI devices of the present invention will necessarily include a dual modal propellant having both high and low burn rate propellant components. More specifically, the propellant employed in the HTI devices of the invention will include low burn rate propellant particles dispersed in a matrix of a high burn rate propellant. That is, the low burn rate propellant particles will most preferably be dispersed homogenously as "islands" throughout a "sea" of the high burn rate propellant.

The low burn rate propellant particles have a size which is most preferably sufficiently large so as to be ignited substantially simultaneously with the high burn rate propellant, but remains ignited for a period of time following expulsion from the HTI. In this regard, the particles virtually may be of any shape including symmetrical, asymmetrical, regular, irregular shapes and mixtures of the same. Thus, the low burn rate propellant particles may be in the form of regular shaped spheres, cubes, cylinders, discs, and/or irregular three-dimensional masses or agglomerations which include a propellant composition having a low burn rate. Most preferably, the low burn rate propellant particles will have an average particle diameter of between about 6 mm to about 25 mm, and more preferably between about 15 mm to about 25 mm.

Virtually any solid propellant that is conventionally employed for rocket motors may be employed in the present invention. In this regard, both the high and low burn rate propellants employed in the HTI devices of the present invention preferably contain ammonium perchlorate (AP) as an oxidizer dispersed homogeneously throughout an energetic solid matrix binder, preferably a hydroxyl-terminated polybutadiene (HTPB). Other additives conventionally employed in solid rocket propellants, for example, aluminum powder may likewise be employed in the present invention. In this regard, the AP will preferably be present in the propellant in an amount between about 55–95 wt. % while the HTPB is present in amounts between about 10 to about 45 wt. %, based on the total weight of the propellant composition. If present, the aluminum powder will typically be employed in amounts ranging from about 5 to about 20 wt. %, based on the total weight of the propellant composition, in which case the AP is present in amounts preferably ranging from about 70 to about 85 wt. % with HTPB being employed as the balance of the propellant weight.

The solid propellant formulations as noted above may be modified with one or more burn rate additive in amounts sufficient to impart to the propellant high burn rate and low burn rate properties, respectively. In this regard, a burn rate suppressant, such as an oxamide, such as cyanoguanidine or dicyandiamide oxamide or the like, may be employed in amounts sufficient to achieve the low burn rate properties noted previously. Similarly, a burn rate accelerator, such as a metal oxide or the like, may be employed in amounts sufficient to achieve the high burn rate properties noted previously.

The metal or metal oxide powder that may be used in the high burn propellants of the present invention includes those based on iron, aluminum, copper, boron, magnesium, manganese, silica, titanium, cobalt, zirconium, hafnium, and tungsten. Other metals such as chromium, vanadium, and nickel may be used in limited capacity since they pose certain toxicity and environmental issues for applications such as automotive airbags. Examples of the corresponding metal oxides include for example: oxides of iron (i.e., $Fe_2O_3$, $Fe_3O_4$); aluminum oxide (i.e., $Al_2O_3$); magnesium oxide (MgO); titanium oxide ($TiO_2$); copper oxide (CuO); boron oxide ($B_2O_3$); silica oxide ($SiO_2$); and various manganese oxides, such as MnO, $MnO_2$ and the like. As is well known to those skilled in this art, the finely dispersed or fumed form of these catalysts and ballistic modifiers are often the most effective. These metal or metal oxide powders may be used singly, or in admixture with one or more other such powder. One particularly preferred powder for use in the high burn rate propellant compositions employed in the present invention includes superfine iron oxide powder commercially available from Mach I Corporation of King of Prussia, Pa. as NANOCAT® superfine iron oxide material. This preferred iron oxide powder has an average particle size of about 3 nm, a specific surface density of about 250 $m^2g$, and bulk density of about 0.05 gm/ml.

As noted above, the burn rate suppressant and burn rate accelerator will each be employed respectively in amounts sufficient to achieve high and low burn rate properties. Most preferably, the burn rate suppressant and burn rate accelerator will be employed respectively in the high burn rate propellant and the low burn rate propellant in an amount between about 0.25 to about 10.0 wt. %, and more preferably between about 1.0 wt. % to about 5.0 wt. %.

Various additives can also be incorporated into the low burn rate propellant particles in order to promote a variety of functional attributes thereto. For example, additives may be incorporated into the low burn rate propellant particles so as to improve ambient burn rate characteristics (for example, pyrophoric chemicals such as sodium, magnesium or red phosphorus), and/or to tailor radiant energy for specific wavelengths (e.g., ultraviolet, infrared, and the like) or decomposition products (e.g., hydrochloric acid) and/or enhance the propellant's ability to destroy specific chemical and/or biological agents. If employed, such optional additives will typically be present in amounts between 1 wt. % to about 20 wt. %, and more preferably between about 5 wt. % to about 10 wt. %.

The low burn rate propellants may be prepared in virtually any conventional manner. That is, the components forming the low burn rate propellant may be mixed, cast and cured in accordance with known techniques. In this regard, the propellant may be cast into the desired shapes, or a monolithic block of the cast propellant may be comminuted to form pieces of the desired size.

As briefly noted above, the low burn rate propellant particles are most preferably dispersed as islands in a sea of high burn rate propellant composition. Again, conventional techniques may be employed to disperse the low burn rate propellant particles in the high burn rate propellant matrix. Thus, the low burn rate propellant particles may be mixed homogeneously in a melt of the high burn rate propellant. The mixture may then be cast in place within a housing of an HTI device and cured therein.

Accompanying FIG. 1A shows in a schematic manner, one presently preferred embodiment of a HTI device 10 in accordance with the present invention. As shown, the HTI device 10 includes a propellant casing 12 which terminates in a nozzle 14. The casing 12 contains a dual-mode propellant mixture comprised of low burn rate propellant particles 16 dispersed throughout a matrix of high burn rate propellant 18.

In operation, the high burn rate propellant 18 will be ignited using a conventional igniter (not shown) thereby generating combustion gases which are expelled through the nozzle 14. Such a state is shown in accompanying FIG. 1B. As the ignited face of the high burn rate propellant 18 regresses (i.e., as shown by the dashed line representation of the unignited face 20*a*, and the irregular line representation of the regressing ignition face 20*b* in FIG. 1B), the low burn rate particles 16 will similarly become ignited. Since the low burn rate particles 16 burn at a lesser rate as compared to the high burn rate propellant 18, the ignited particles per se (a few of which are noted in FIG. 1B by reference numeral 16*a* in FIG. 1B) will be expelled through the nozzle 14 and will therefore continue to burn in the ambient environment. Such continued burning of the particles 16*a* will be sufficient to destroy chemical and/or biological agents that may be present in the ambient environment.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A high temperature incendiary (HTI) device to destroy chemical and/or biological agents present in an ambient environment, said HTI device comprising:

a dual modal propellant composition comprised of low burn rate propellant particles dispersed in a matrix of a high burn rate propellant, wherein said low burn rate propellant particles comprise ammonium perchlorate (AP) as an oxidizer, a hydroxyl-terminated polybutadiene (HTPB) and a burn rate suppressant in an amount sufficient to achieve a burn rate of less than about 0.25 inches per second (ips) at a pressure condition of 1.000 psi, and wherein said high burn rate propellant comprises ammonium perchlorate (AP) as an oxidizer, a hydroxyl-terminated polybutadiene (HTPB) and a burn rate accelerator in an amount sufficient to achieve a burn rate of at least about 1.00 inches per second (ips) at a pressure condition of 1.000 psi, and wherein combustion of said high burn rate propellant generates combustion gases which expel ignited low burn rate propellant particles in the ambient environment, which ignited low burn rate propellant particles thereby continue burning so as to destroy the chemical and/or biological agents present in the ambient environment.

2. The HTI device of claim 1, wherein said burn rate suppressant includes an oxamide.

3. The HTI device of claim 2, wherein said oxamide is at least one selected from the group consisting of cyanoguanidine and dicyandiamide oxamide.

4. The HTI device of claim 1, wherein said burn rate accelerator includes metal or metal oxide particles.

5. The HTI device of claim 4, wherein said metal or metal oxide particles are at least one selected from the group consisting of iron, aluminum, copper, boron, magnesium, manganese, silica, titanium, cobalt, zirconium, hafnium, tungsten and corresponding oxides thereof.

6. HTI device of claim 1, comprising a casing containing said dual modal propellant composition, and a nozzle through which combustion gases pass which are generated by combustion of said propellant composition pass.

7. The HTI device of claim 1, wherein said low burn rate propellant particles have a burn rate of less than about 0.10 ips or greater at said pressure condition.

8. The HTI device of claim 1, wherein said high burn rate propellant has a burn rate of at least about 2.00 ips or greater at said pressure condition.

9. The HTI device of claim 1 or 7, wherein said low burn rate propellant particles have an average particle diameter of between about 6 mm to about 25 mm.

* * * * *